US009027203B2

(12) United States Patent
Conrad et al.

(10) Patent No.: US 9,027,203 B2
(45) Date of Patent: May 12, 2015

(54) SURFACE CLEANING APPARATUS

(75) Inventors: Wayne Ernest Conrad, Hampton (CA); Dave Petersen, Bowmanville (CA)

(73) Assignee: G.B.D. Corp., Nassau (BS)

( * ) Notice: Subject to any disclaimer, the term of this patent is extended or adjusted under 35 U.S.C. 154(b) by 839 days.

(21) Appl. No.: 13/256,031

(22) PCT Filed: Mar. 9, 2010

(86) PCT No.: PCT/CA2010/000341

§ 371 (c)(1),
(2), (4) Date: Sep. 12, 2011

(87) PCT Pub. No.: WO2010/102395

PCT Pub. Date: Sep. 16, 2010

(65) Prior Publication Data

US 2012/0000033 A1 Jan. 5, 2012

(30) Foreign Application Priority Data

Mar. 13, 2009 (CA) ..... 2658161

(51) Int. Cl.
*A47L 9/02* (2006.01)
*A47L 5/28* (2006.01)

(52) U.S. Cl.
CPC .... *A47L 5/28* (2013.01); *A47L 9/02* (2013.01)

(58) Field of Classification Search
CPC ..... A47L 5/28; A47L 9/02
USPC ..... 15/415.1, 421
IPC ..... A47L 9/02
See application file for complete search history.

(56) References Cited

U.S. PATENT DOCUMENTS

| | | | |
|---|---|---|---|
| 3,952,362 | A | 4/1976 | Torii |
| 4,395,794 | A | 8/1983 | Duncan |

FOREIGN PATENT DOCUMENTS

| | | | |
|---|---|---|---|
| CA | 1155258 | A1 | 10/1983 |
| CA | 1251006 | A1 | 3/1989 |
| CA | 2444485 | A1 | 10/2003 |
| CN | 1426738 | A | 7/2003 |
| GB | 2378643 | A | 2/2003 |
| JP | 53109663 | A | 9/1978 |
| JP | 53109663 | A | 9/1989 |
| JP | 2001212045 | A | 8/2001 |
| KR | 200 0032443 | A | 3/2007 |

OTHER PUBLICATIONS

International Preliminary Report on Patentability received in connection to International patent application No. PCT/CA2010/000341, mailed on Sep. 13, 2011.
International Search Report received on the corresponding international patent application No. PCT/CA2010/000341.

*Primary Examiner* — David Redding
(74) *Attorney, Agent, or Firm* — Philip C. Mendes da Costa; Bereskin & Parr LLP/S.E.N.C.R.L., s.r.l.

(57) ABSTRACT

A surface cleaning head comprising one or more lower open sided air flow passages is provided. One or both air flow passages may be a lower open sided air flow passage and may have a rib to prevent carpet of the like from blocking the air flow passage. One of the passages may be a deep cleaning slot.

19 Claims, 9 Drawing Sheets

SURFACE CLEANING APPARATUS

FIELD

The specification relates to surface cleaning heads. More particularly, the specification relates to surface cleaning heads for surface cleaning apparatuses such as vacuum cleaners.

INTRODUCTION

The following is not an admission that anything discussed below is prior art or part of the common general knowledge of persons skilled in the art.

U.S. Pat. No. 4,395,794 discloses a vacuum cleaner intake device formed of a V-shaped housing widening in the direction of working. The housing has a funnel shape nozzle, a fitting at the apex of the nozzle for connection to a source of suction and a pair of arms extending in a V-shape respectively forwardly and laterally of the nozzle. A pair of sidewalls is provided each having a skid at its lower edge elevating the housing above the floor. A hood covers and defines with the arms and the sidewalls a collection chamber open at the forward and rear edges. Each of the arms are provided on their bottom surface with a pair of spaced battens defining between them an elongated suction groove open to the collection chamber and extending outwardly through the sidewall.

SUMMARY

The following introduction is provided to introduce the reader to the more detailed discussion to follow. The introduction is not intended to limit or define the claims.

According to one broad aspect, a surface cleaning head is provided wherein a surface cleaning head, such as a vacuum cleaner head, has first and second airflow passages. In one embodiment, the first and second airflow passages have differing airflow rates such that one of the passages comprises a deep cleaning suction slot. Accordingly, the first airflow passage may be of various designs and may be configured to draw in larger particulate matter. The first airflow passage may have a larger cross sectional area then the second airflow passage. Preferably, each comprises a lower open sided airflow chamber.

In an alternate embodiment, or in the same embodiment, the first and second airflow passages may be in communication directly with a source of suction. For example, each of the airflow passage may have an outlet that is in direct communication with an airflow passage extending to the suction motor or a manifold upstream from such an outlet. In particular, one of the passages does not branch off the other passage. Accordingly, the vacuum level in each passage may be independently designed by selecting an appropriate cross sectional area for the passage.

In an alternate embodiment, or in the same embodiment, a surface cleaning head comprises a lower open sided airflow chamber wherein at least one rib is provided. The rib preferably extends downwardly from a lower surface of the roof of the airflow chamber. A plurality of such ribs may be provided. The ribs preferably extend in the direction of airflow through the chamber. The ribs are preferably spaced apart from each other and preferably from the side walls of the air flow chamber. The ribs may assist in keeping the airflow chamber open when the surface cleaning head is used, e.g., on an area rug or carpeting that is not glued to a floor. For example, an air flow channel that extends across the front of a surface cleaning head may have a sufficient vacuum level such that carpeting may be drawn up into the air flow chamber and block or partially block the chamber.

For example, the surface cleaning head may comprise a front end, a rear end and lateral sides extending between the front and rear ends. A first airflow passage may extend rearwardly from a front dirty air inlet and have an air outlet end communicating directly with an air outlet. The first airflow passage has a lower side wherein at least a portion of the lower side is open. The surface cleaning head further comprises a second airflow passage having an air outlet end communicating directly with the air outlet.

In some examples, the second airflow passage comprises a second airflow passage lower side, wherein at least a portion of the second airflow passage lower side is open.

In some examples, all of the lower side of the first and/or second airflow passage is open.

In some examples, the second airflow passage comprises a deep cleaning slot.

In some examples, the second airflow passage has a side dirty air inlet at one of the lateral sides. In some examples, the surface cleaning apparatus further comprises a third airflow passage, wherein the third airflow passage has a side dirty air inlet at the other of the lateral sides. The second and third airflow passages may comprise transversely extending passages extending across the bottom of the surface cleaning head.

In some examples, the air outlet comprises a manifold, and each of the passages has an end at the manifold. In some examples, the manifold has an open lower side.

In some examples, each of the passages is configured such that less than 75% of air entering the air outlet is drawn from the first airflow passage. In some examples, each of the passages is configured such that less than 50% of air entering the air outlet is drawn from the first airflow passage. For example, the outlet of each passage may be sized to produce a selected level of vacuum in each passage.

In some examples, the first airflow passage has a cross sectional area that decreases in size in the downstream direction. In some examples, the second airflow passage has a cross sectional area that increases in size in the downstream direction.

In some examples, the first airflow passage comprises side members extend inwardly in a downstream direction whereby the first airflow passage is generally a truncated V shape.

In some examples, the air outlet has a lower portion that is spaced above a floor when the surface cleaning head is placed on the floor.

In some examples, the air outlet end of the first passage has an upper wall and the air outlet is recessed upwardly from the upper wall.

In another embodiment, there is provided, a surface cleaning head comprising a front end, a rear end and lateral sides extending between the front and rear ends. A first airflow passage extends rearwardly from a front dirty air inlet and have an air outlet end communicating directly with an air outlet, the first airflow passage having a lower side, wherein at least a portion of the lower side is open, wherein at least one rib positioned in the air flow passage.

In some examples, the rib may be spaced inwards from lateral sides of the airflow passage.

In some examples, the rib may extend generally in a direction of air flow through the airflow passage.

It will be appreciated that a surface cleaning head may incorporate one or more of the features of each of these embodiments and examples.

DRAWINGS

DESCRIPTION OF VARIOUS EMBODIMENTS

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

Figure 4:
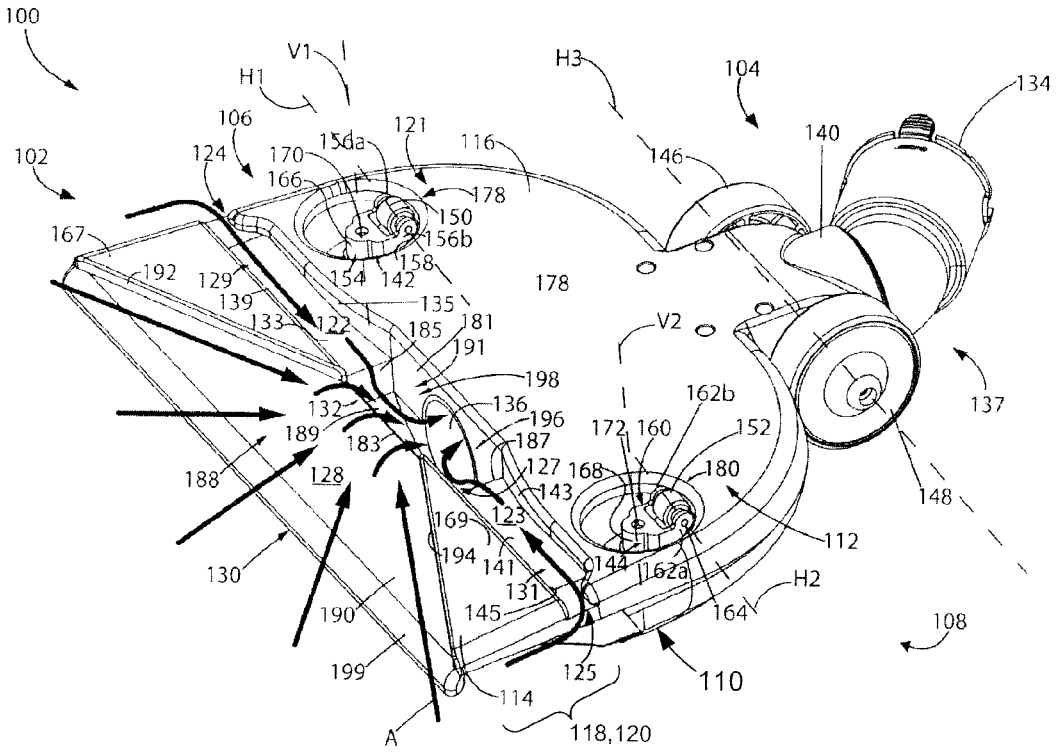
FIG. 4 is a bottom perspective view of the surface cleaning head of FIG. 1.
Figure 5:
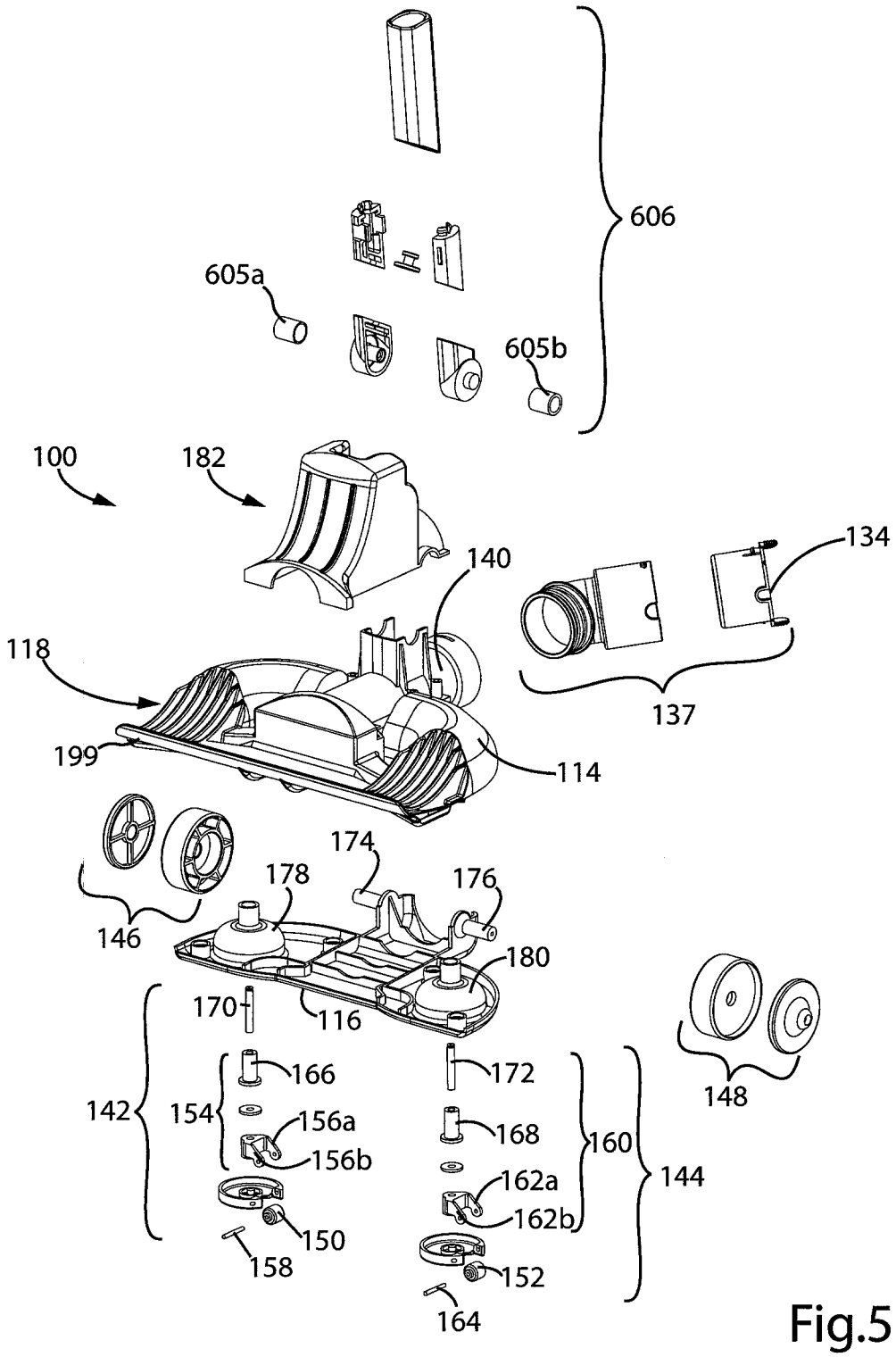
FIG. 5 is an exploded view of the surface cleaning head of FIG. 1.
Figure 6:
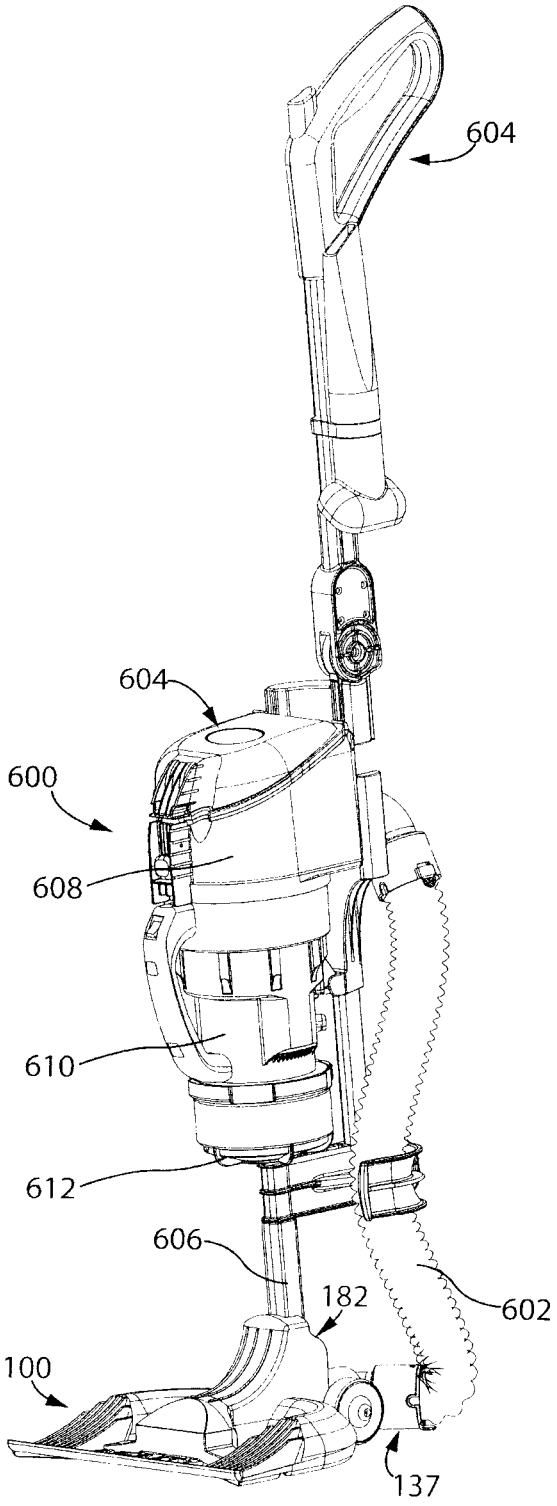
FIG. 6 is a front perspective view of a surface cleaning apparatus comprising the surface cleaning head of FIG. 1.
Figure 7:
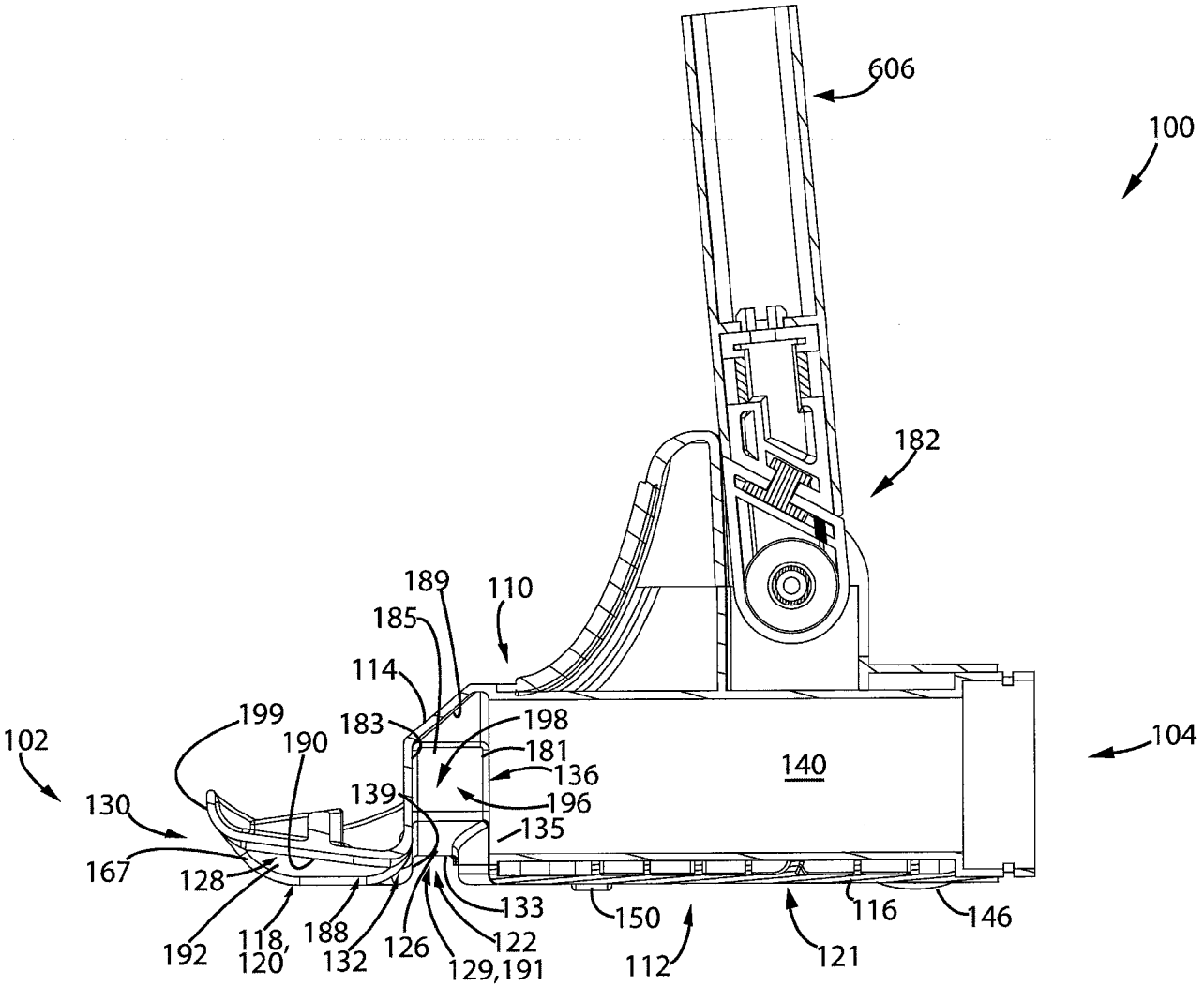
FIG. 7 is a cross-section taken along line 7-7 in FIG. 3.

Referring to FIGS. 1-5 and 7-9, an example of a surface cleaning head 100 is shown. Referring to FIG. 6, as will be described further hereinbelow, the surface cleaning head 100 is connectable in air flow communication to any surface cleaning apparatus 600, such as an upright vacuum cleaner or a canister vacuum cleaner, and preferably, an upright vacuum cleaner.

Figure 1:
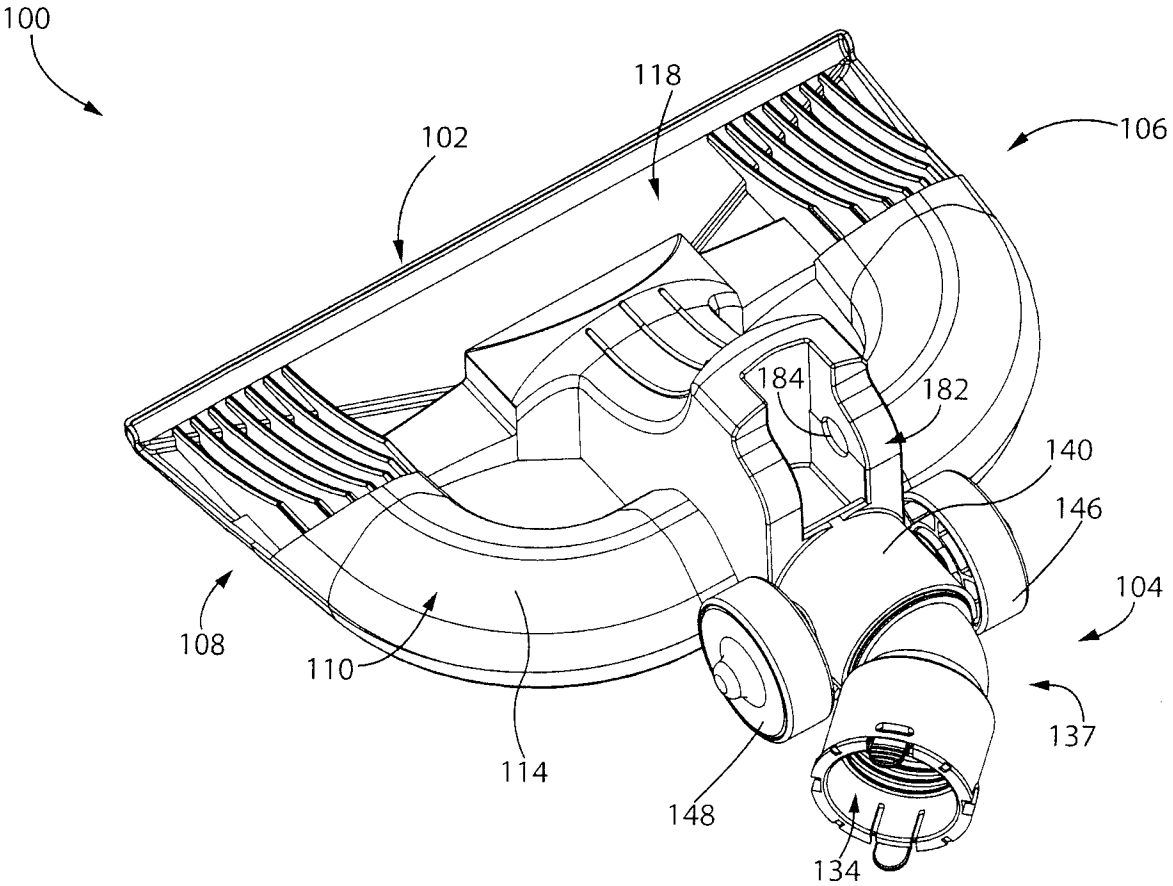
FIG. 1 is a top perspective view of an embodiment of a surface cleaning head.
Figure 2:
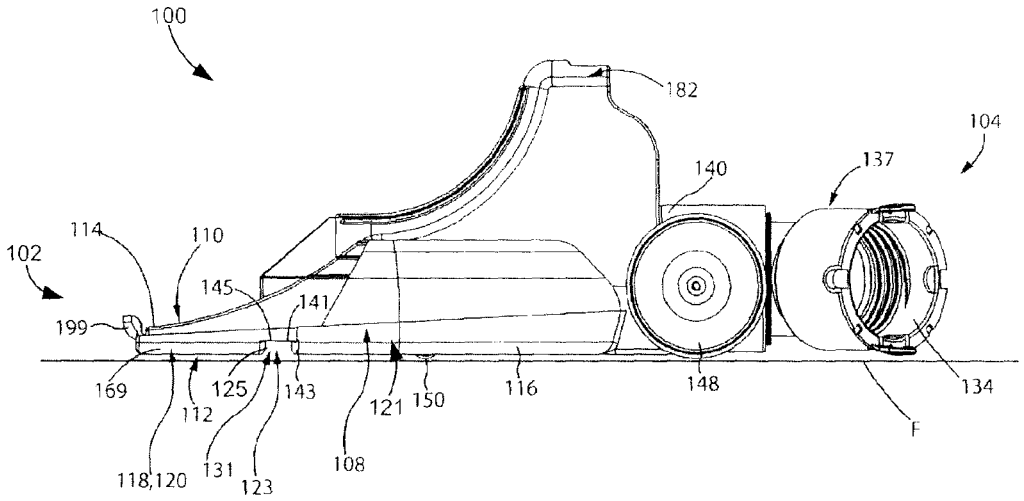
FIG. 2 is a side elevation view of the surface cleaning head of FIG. 1.
Figure 3:
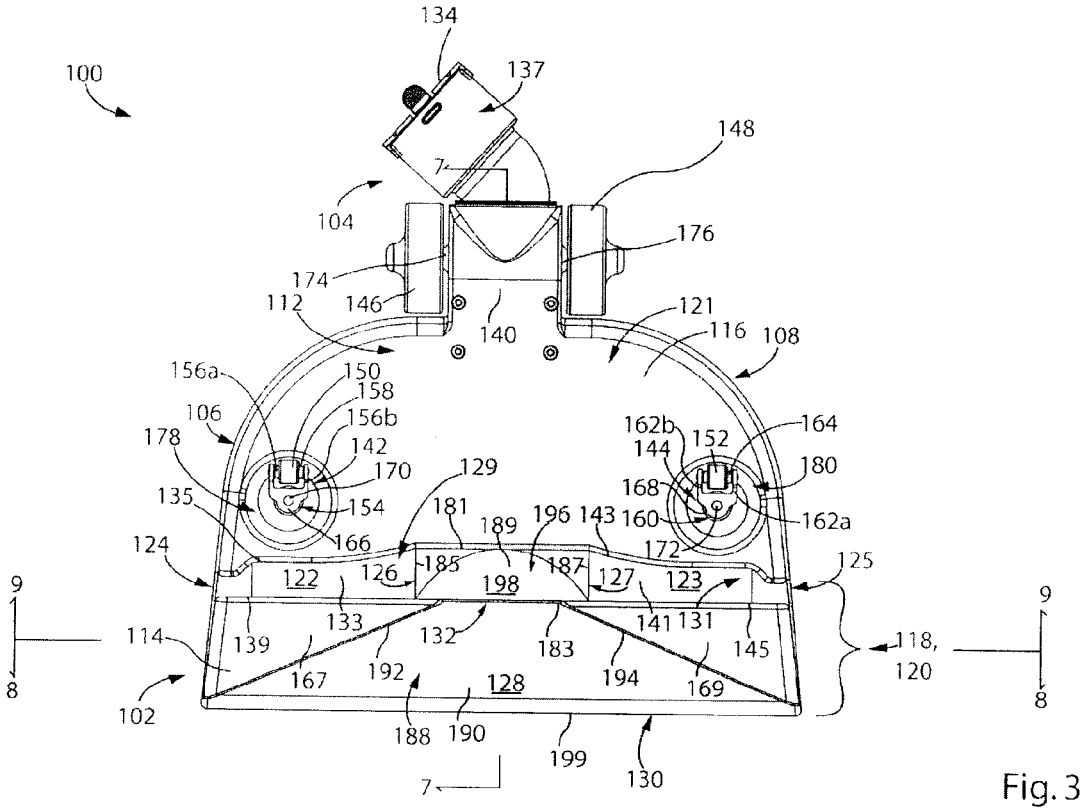
FIG. 3 is a bottom plan view of the surface cleaning head of FIG. 1.

Referring to FIGS. 1 to 3, the surface cleaning head 100 comprises a front end 102, and a rear end 104. The surface cleaning head further comprises first 106 and second 108 opposed lateral sides extending between the front 102 and rear 104 ends. A top surface 110 and a bottom surface 112 each extend between the front end 102 and the rear end 104, and the opposed lateral sides 106, 108. It will be appreciated that the surface cleaning head 300 may be of any shape and preferably has a front 102 that is straight.

It will be appreciated that the surface cleaning head 300 may be constructed from any number of parts. A simplified construction that may be used is exemplified. In the exemplified embodiment, a clam shell construction is utilized whereby a lower open sided air chamber is formed by having a portion of the top member of the clam shell extend forward of the lower clam shell portion. This construction may be used by itself or with other features of a surface cleaning head set out herein. Preferably, as exemplified, the surface cleaning apparatus comprises a top plate 114, and a bottom plate 116. The top plate 114 extends forwardly of the bottom plate 116. Accordingly, a front portion 118 of the top plate 116 forms a front portion 120 of bottom surface 112, and the bottom plate 116 forms a rear portion 121 of the bottom surface 112.

In alternate embodiments, the top plate 114 and the bottom plate 116 may extend for equal distances. In such embodiments, the bottom plate may form all of the bottom surface 112.

Preferably, as exemplified, the surface cleaning apparatus 100 comprises a front dirty air inlet 130, through which dirt laden air enters the surface cleaning head 100. A first airflow passage 128 extends rearwardly from the front dirty air inlet 130 to an air outlet end 132. Preferably, the first airflow passage 128 is integrally formed in front portion 118 of the top plate 116. For example, as shown, the first airflow passage is defined by a top wall 190 and sidewalls 192 and 194. The top wall 190 comprises a portion of the front portion 118 of the top plate 114, and the sidewalls 192, 194 extend downwardly on opposed sides of the front portion 118 of the top plate. Preferably, the first airflow passage 128 has a lower side 188, wherein at least a portion, and preferably all, of the lower side 188 is open. For example, as shown, the entire lower side 188 of the first airflow passage 128, opposed to the top wall 190 and extending between sidewalls 192, 194, is open.

In the exemplified embodiment, the sidewalls 192, 194 are angled inwardly, away from lateral sides 106 and 108, in the direction towards air outlet end 132. Accordingly, airflow passage 128 decreases in cross sectional area in the downstream direction, from inlet 130 to air outlet end 132. For example, as shown, the air inlet 130 extends across the entire width of the surface cleaning head 100, from the first lateral side 106 to the second lateral side 108. The air outlet end 132 extends across only a portion of the width. Preferably, the air outlet end 132 extends across between 20% and 35% of the width. The width of outlet 132 will vary depending, for example, on the cross sectional area of the second passage, the height of the outlet 132.

The air outlet end 132 of the first airflow passage 128 communicates directly with an air outlet 196. In the example shown, the air outlet 196 comprises a manifold 198. As exemplified, the manifold 198 comprises a rear 181, a front 183, and opposed lateral sides 185, 187. In the example shown, the first airflow passage 128 is in communication with the manifold 198 at the front 183. Further, In the example shown, the manifold has an outlet port 136 at rear 181

As exemplified, the manifold 198 has a top wall 189 extending between rear 181, front 183, and sides 185, 187. The top wall comprises a portion of front portion 118 of top plate 114. Preferably, the lower side 191 of manifold 198 is open.

Preferably, the air outlet 196 is recessed upwardly from the portion of the top wall 190 at the air outlet end 132. For example, as shown, front side 183 of manifold 196 extends upwardly from air outlet end 132.

Figure 9:
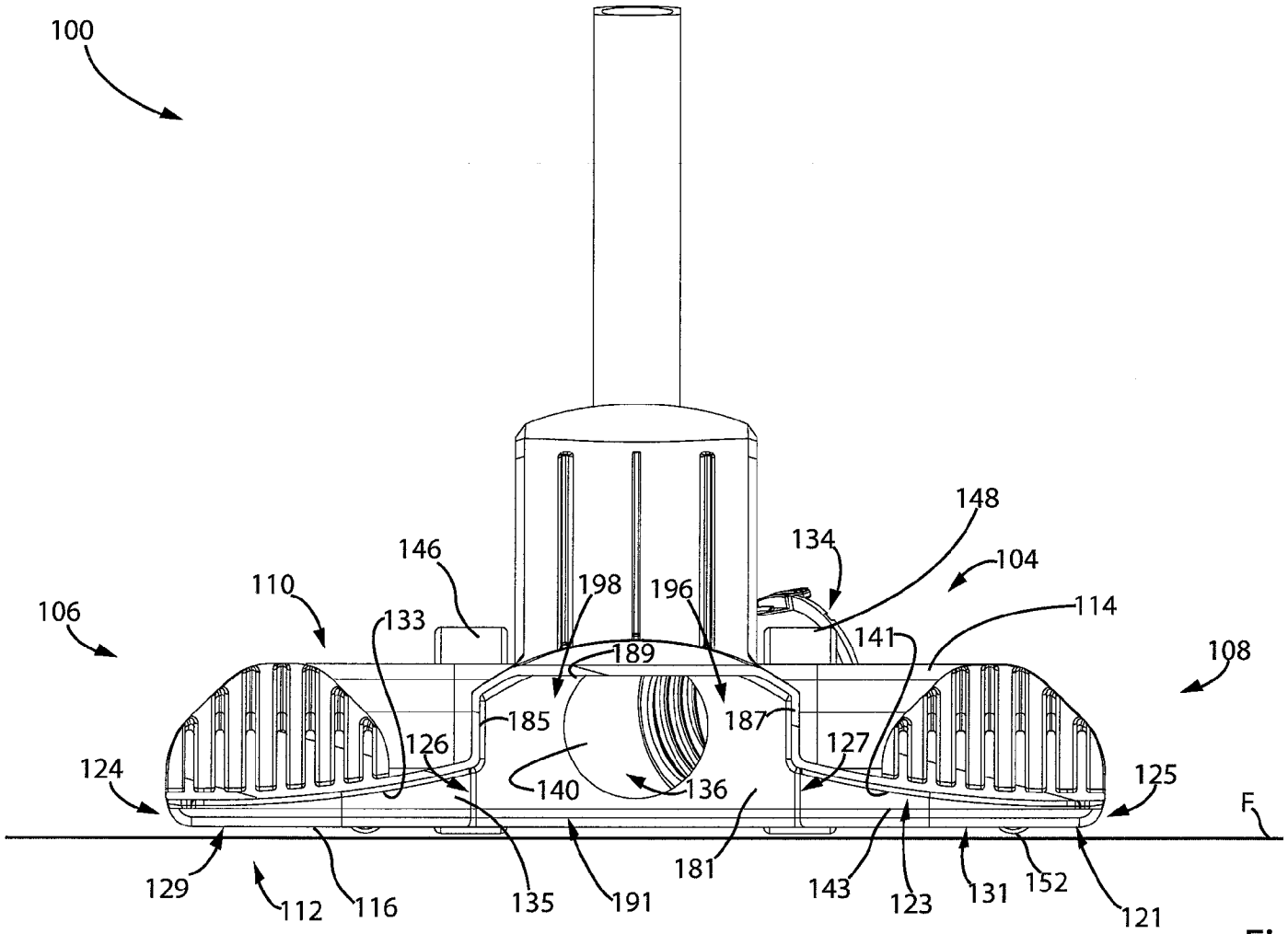

Preferably, the air outlet 196 has a lower portion that is spaced above a floor when the surface cleaning head is placed on a floor. For example, as shown in FIG. 9, lower side 191 of manifold 198 is spaced above floor F.

In alternate embodiments, the air outlet 196 may comprise, for example, an outlet port in direct communication with the air outlet end 132. That is, a manifold may not be provided.

As exemplified, the surface cleaning head 100 comprises one or more additional airflow passages. Preferably, as exemplified in FIG. 3, the surface cleaning head further comprises a second airflow passage 122 and a third airflow passage 123. It will be appreciated that second and third passages may alternately be configured as a single passage.

As exemplified, the second airflow passage 122 comprises an air inlet 124, and an air outlet end 126, and the third flow passage 123 comprises an air inlet 125 and an air outlet end 127. In the exemplified embodiment, the second airflow passage 122 extends inwardly from lateral side 106 such that the air inlet 124 to the second airflow passage 122 is at lateral side 106. Accordingly, air inlet 124 forms a first side dirty air inlet 124 to the surface cleaning head 100. Further, the third airflow passage 123 extends inwardly from lateral side 108 such that the air inlet 125 to the third airflow passage 123 is at lateral side 108. Accordingly, air inlet 125 forms a second side dirty air inlet 125 to the surface cleaning head 100.

Preferably, at least a portion, and preferably all, of the lower side of the second and third airflow passages is open. Accordingly the passages may be formed as deep cleaning slots. It will be appreciated that, in some embodiments, side inlets may not be provided.

In the preferred embodiment, the second airflow passage 122 has a lower side 129 wherein at least a portion of the lower side 129 is open. Similarly, the third 123 airflow passage may have a lower side wherein at least a portion of the lower side 131 is open. For example, as shown, the second airflow passage 122 comprises a top wall 133, which comprises a portion of front portion 118 of top plate 114, and opposed sidewalls 135, 139, extending downwardly from top wall 133. The entire lower side 129, which is opposed to top wall 133, and extends between sidewalls 135, 139, and inlet 124 and outlet 126, is open. Further, as shown, the third airflow passage 123 comprises a top wall 141, which comprises a portion of front portion 118 of top plate 114, and opposed sidewalls 143, 145, extending downwardly from top wall 141. The entire lower side 131, which is opposed to top wall 133, and extends between sidewalls 135, 139, and inlet 124 and outlet 126, is open.

In the exemplified embodiment, side wall 139 and side wall 192 are formed by a first triangular member 167 on front portion 118 of top plate 114. Further, sidewall 145 and side wall 194 are formed by a second triangular member 169 of front portion 118 of top plate 114.

Preferably, the second airflow passage 122 has a cross-sectional area that increases in size in the downstream direction. More preferably, as shown, both the second 122 and the third 123 airflow passages have a cross sectional area that increase in size in the downstream direction. More particularly, second side air inlet 124 has a smaller cross sectional area than second air outlet end 126, and third side air inlet 125 has a smaller cross sectional area than third air outlet end 127. An advantage of this design is that a higher vacuum level may be obtained at a portion of passages adjacent the lateral sides.

Preferably, as in the exemplified embodiment, the air outlet end 126 of the second airflow passage 122 communicates directly with air outlet 196. Further, in the preferred embodiment, the air outlet 127 of the third airflow passage 123 communicates directly with air outlet 196. For example, as shown, the air outlet end 126 of the second airflow passage 122 is at lateral side 185 of manifold 198, and the air outlet end 127 of third airflow passage 123 is at lateral side 187 of manifold 198. Accordingly, the vacuum level in passages 122 and 123 is based on the vacuum level in manifold 198 and not the vacuum level in passage 128.

Preferably, as in the exemplified embodiment, the second airflow passage 122 comprises a deep cleaning slot. More preferably, both the second 122 and third 123 airflow passages comprise deep cleaning slots. For example, as shown, the outlet ends 126 and 127 of the second 122 and third 123 airflow passages have a smaller cross-sectional area than the outlet end 132 of the first airflow passage 128. Further, each of the outlet ends 126, 127, and 132 are in communication with manifold 198. Accordingly, the pressure in manifold 198 to which each of the outlet ends 126, 127, and 132 is exposed is substantially the same. As the outlet ends 126 and 127 of the second 122 and third 123 airflow passages have a smaller cross-sectional area than the outlet end 132 of the first airflow passage 128, the flow rate of air through the outlet ends 126 and 127 of the second 122 and third 123 airflow passages will be higher than the flow rate of air through the first airflow passage 128. Accordingly, due to this high flow rate, the second and third airflow passages serve as deep cleaning slots, and air passing through these passages may entrain heavier particles or particles that are below the surface of a surface to be cleaned, such as particles that are embedded in a carpet. The first air passage may serve as a coarse cleaning passage, and in use, air flowing through the first air passage may entrain light particles on the surface of a surface to be cleaned.

Preferably, preferably, the each of the outlet ends 126, 127, 132 is configured such that less than 75% of air entering opening 136 is drawn from the first airflow passage 132. Most preferably, each of the outlet ends is configured such that less than 50% of air entering opening 136 is drawn from the first airflow passage 132. It will be appreciated that the air flow distribution may be varied by varying the size of the outlets.

It will be appreciated that outlet port 136 may be in communication with a suction source by any means known in the vacuum cleaner arts. Further, cleaning head 300 may be connected to a surface cleaning apparatus by any means known in the vacuum cleaner arts. As exemplified, outlet port 136 is in communication with a conduit 140, which extends rearwardly from the opening 136. A swivel joint 137 is mounted to a rear end of the conduit 140, and is in airflow communication with the conduit 140. The swivel joint is mountable in airflow communication with the surface cleaning apparatus 600, and comprises the air outlet 134 of the surface cleaning head 100.

The surface cleaning head 100 is preferably configured to transition from a low pile carpet to a high pile carpet. For example, as shown, the front portion 118 of top plate 114 comprises an upwardly curved lip 199. Lip 199 is provided at the front 102 of the surface cleaning head 100, above dirty air inlet 130. Accordingly, if surface cleaning head 100 is pushed from a low pile carpet to a high pile carpet, lip 199 may serve as a ramp, and aid in lifting the surface cleaning head 100 from the low pile carpet onto the high pile carpet. Alternately, or in addition, the triangular members 167 and 169 may curve upwardly together with lip 199 at front end 102. Preferably, lip 199 and triangular members 167, 169 may define a generally continuous ramp or cam surface as exemplified in FIG. 7.

Figure 8:
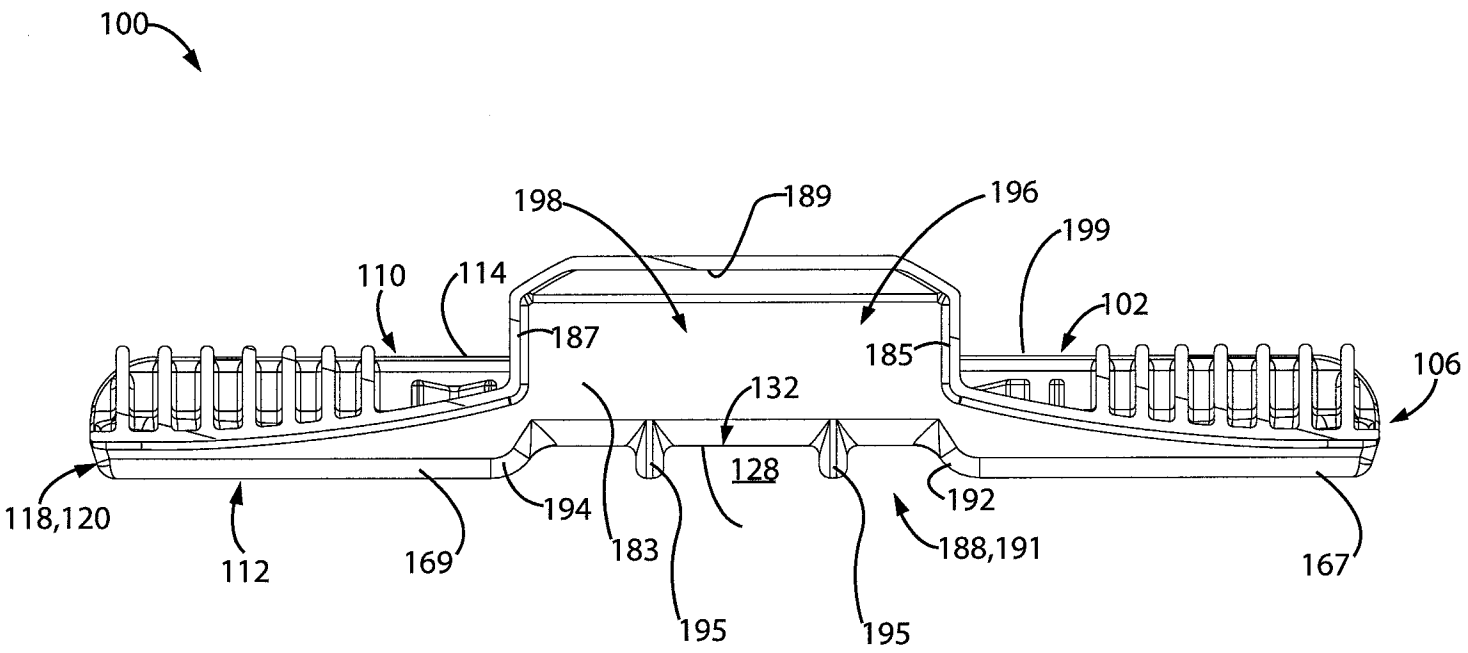
FIG. 8 is a cross-section taken along line 8-8 in FIG. 3 of an alternate embodiment of the surface cleaning head of FIG. 3; and, FIG. 9 is a cross-section taken along line 9-9 in FIG. 3.

In some embodiments, ribs or carpet holders may be provided, which, in use, hold down a carpet, and prevent the carpet from being lifted upward off of a surface by the flow of air through the open sided airflow passages 128, 122, 123. For example, as shown in FIG. 8, two spaced apart carpet holders 195 are provided, which extend downwardly from top wall 190 of first passage 128.

Referring to FIGS. 2 to 5, the surface cleaning head 100 preferably comprises at least two front wheels, and at least two rear wheels. In the exemplified embodiment, the surface cleaning head 100 comprises first 142 and second 144 front wheel assemblies, and first 146 and second 148 rear wheels.

Preferably, the front wheel assemblies 142, 144 are rotatable about vertical axes. More preferably, the front wheel assemblies 142, 144 are rotatable about vertical axes, and comprise wheels that are rotatable about horizontal axes. For example, swivel, caster or ball wheels may be used.

For example, in the exemplified embodiment, the first front wheel assembly 142 comprises a first front wheel 150, and second front wheel 144 assembly comprises a second wheel front 152. The first front wheel assembly 142 further comprises a first bracket 154, having outwardly extending arms 156*a*, 156*b*. The first front wheel 150 is mounted on a first axle 158, which extends horizontally between the arms 156*a*, 156*b*. Accordingly, the first front wheel 150 is rotatable about a horizontal axis H1 defined by first axle 158. The second front wheel assembly 144 further comprises a second bracket 160, having outwardly extending arms 162*a*, 162*b*. The second front wheel 152 is mounted on a second axle 164, which extends horizontally between the arms 162*a*, 162*b*. Accordingly, the second front wheel 152 is rotatable about a horizontal axis H2 defined by axle 164.

As exemplified, the first bracket 154 comprises a first vertically extending portion 166 provided above the outwardly extending arms 156, and the second bracket 160 comprises a second vertically extending portion 168 provided above the outwardly extending arms 162. First 170 and second 172 vertical pins are mounted to the bottom plate 116, and extend downwardly therefrom. The first vertically extending portion 166 is rotatably received on the first pin 170, and the second vertically extending portion 168 is rotatably received on the second pin 172. Accordingly, the first 154 and second 160 brackets are rotatable about first and second vertical pins 170 and 172, respectively, to rotate first 142 and second 144 front wheel assemblies about vertical axes V1 and V2, respectively.

Preferably, as shown in FIG. 4, the horizontal axis of rotation H1 of the first front wheel 150 is spaced from the vertical axis of rotation V1 of the first front wheel assembly 142, and the horizontal axis of rotation H2 of the second front wheel 152 is spaced from the vertical axis of rotation V1 of the first front wheel assembly 144. For example, as exemplified, outwardly extending arms 156*a*, 156*b* extend laterally away from vertically extending portion 166, such that axle 158, which defines axis H1, is spaced from vertically extending portion 166, which defines axis V1. Similarly, outwardly extending arms 162*a*, 162*b* extend laterally away from vertically extending portion 168, such that axle 164, which defines axis H2, is spaced from vertically extending portion 168, which defines axis V2.

Preferably, as shown in FIG. 4, the rear wheels 146, 148 are rotatable about horizontal axes H3. For example, as shown in FIG. 5, the rear wheels 146, 148 are mounted on axles 174 and 176, respectively, which are fixedly mounted on opposed sides of conduit 140, adjacent rear end 104.

Preferably, the rear wheels 146, 148 are positioned closer together than the front wheel assemblies 142, 144. For example, in the exemplified embodiment, the front wheel assemblies 142, 144 are positioned adjacent lateral sides 106, 108, respectively of the surface cleaning head 100. Further, as mentioned hereinabove, the rear wheels 146, 148 are positioned on opposed sides of conduit 140.

Preferably, a portion of each front wheel assembly 142, 144, is recessed upwards from the bottom surface 112 of the surface cleaning head 100. For example as shown in FIGS. 3 and 4, a first recess 178 and a second recess 180 are provided in bottom plate 116, and extend upwardly. The first front wheel assembly 142 may be mounted in the first recess 178, such that bracket 154 is completely received within the first recess 178, and a portion of wheel 150 extends from the first recess 178. The second front wheel assembly 144 may be mounted in the second recess 180, such that bracket 160 is completely received within the first recess 180, and a portion of wheel 152 extends from the second recess 180. As shown in FIG. 3, this allows bottom surface 112 to sit in close proximity to a floor F.

Preferably, the front wheels 150, 152 have a smaller diameter than the rear wheels 146, 148.

Referring to FIG. 1, in the exemplified embodiment, surface cleaning head 100 further comprises a pivot joint 182, which is mounted to top plate 114. The pivot joint 182 comprises laterally opposed apertures 184 (only one aperture shown). The pivot joint 182 is positioned between the front wheel assemblies 142, 144 and the rear wheels 146, 148. As shown in FIG. 6, a support 606 of the surface cleaning apparatus 600 is pivotally mounted to the pivot joint 182 by a pivot pins 605*a*, 605*b*.

Referring now to FIG. 6, a surface cleaning apparatus 600 comprising surface cleaning head 100 is shown. It will be appreciated that surface cleaning head 100 may be mounted to any suitable surface cleaning apparatus, and surface cleaning apparatus 600 is exemplary only.

In the embodiment shown, surface cleaning apparatus 600 comprises a flexible hose 602, which is mounted to optional swivel joint 137 and is in fluid communication with air outlet 136. Hose 602 extends upwardly to a cleaning unit 604. The cleaning unit 604 is mounted to support 606, which is pivotally mounted to pivot joint 182 of surface cleaning head 100. The cleaning unit 604 includes a cleaning apparatus 608. The cleaning apparatus 608 is in fluid communication with hose 602, and serves to separate dirt from air. The cleaning apparatus 608 may be any type of cleaning apparatus, such as one or more cyclonic cleaning units, and/or one or more filters. The cleaning unit further comprises a suction motor 610, which draws air into the dirty air inlets of surface cleaning head, through surface cleaning head 100 to outlet 136, through house 602, through cleaning apparatus 608, and out of a clean air outlet 612 of the surface cleaning apparatus 600. A handle 614 may be mounted to cleaning unit 604, and may be gripped by a user to move surface cleaning head 100 along a surface.

The invention claimed is:

1. A surface cleaning head comprising:

a front end, a rear end and lateral sides extending between the front and rear ends;

a first airflow passage extending rearwardly from the front end to a upwardly extending manifold that is upstream of an air flow conduit, the first airflow passage having a height at the front end that is greater than a height at a rear end of the first air flow passage, the first airflow passage having a rigid lower side, wherein at least a portion of the lower side is open; and, front and rear wheels wherein the lower side has a front end, a rear end and lateral sides and the lateral sides are spaced positioned above a bottom of the front wheels when the surface cleaning head is positioned on a floor.

2. The surface cleaning head of claim 1 further comprising a second airflow passage comprising a second airflow passage lower side and a side dirty air inlet at one of the lateral sides, wherein at least a portion of the second airflow passage lower side is open and an outlet end of the second air flow passage is in communication with the manifold.

3. The surface cleaning head of claim 2 further comprising a third airflow passage, wherein the third airflow passage has a side dirty air inlet at the other of the lateral sides.

4. The surface cleaning head of claim 2 wherein each of the passages is configured such that less than 75% of air entering the air outlet is drawn from the first airflow passage.

5. The surface cleaning head of claim 2 wherein each of the passages is configured such that less than 50% of air entering the air outlet is drawn from the first airflow passage.

6. The surface cleaning head of claim 2 wherein the second airflow passage has a cross sectional area that increases in size in the downstream direction.

7. The surface cleaning head of claim 1 wherein all of the lower side is open.

8. The surface cleaning head of claim 1 wherein the manifold has an open lower side.

9. The surface cleaning head of claim 1 wherein the first airflow passage has a cross sectional area that decreases in size in the downstream direction.

10. The surface cleaning head of claim 9 wherein the first airflow passage comprises side members extend inwardly in a downstream direction whereby the first airflow passage is generally a truncated V shape.

11. The surface cleaning head of claim 1 wherein the front end is curved upwardly.

12. The surface cleaning head of claim 1 wherein the lower surface is spaced from the floor to define an air gap between the lower end and the floor and the gap has a height that decreases from front end towards a rear end of the first passage.

13. The surface cleaning head of claim 1 wherein the lower surface is spaced from the floor to define an air gap between the lower end and the floor and the gap has a height that decreases from front end to a rear end of the first passage.

14. The surface cleaning head of claim 1 wherein the lower surface is curved upwardly at the front end.

15. The surface cleaning head of claim 1 further comprising at least one rib positioned in the air flow passage, the rib having a front end, a rear end and laterally extending sides wherein each side is positioned in the air flow passage.

16. The surface cleaning head of claim 1 further comprising at least one rib positioned in the air flow passage, the rib extending transverse to the front end.

17. A surface cleaning head comprising:

a front end, a rear end, lateral sides extending between the front and rear ends, front wheels and rear wheels;

a lower extent that faces a floor when the surface cleaning head is positioned on the floor, the lower extent curving downwardly in a rearward direction, a front portion of the lower extent is spaced from the floor to define an air gap between the lower extent and the floor and the gap has a height that decreases in the rearward direction; and, an upwardly extending passage positioned rearward of the lower extent and upstream of an air flow conduit, the upwardly extending passage is narrower than the front end, the first airflow passage having a height at the front end that is greater, the front wheels positioned laterally outwardly from the upwardly extending passage.

18. The surface cleaning head of claim 17 further comprising a rib that is spaced inwardly from lateral sides of the air flow passage.

19. The surface cleaning head of claim 18 wherein the rib extends generally rearwardly.

* * * * *